US005704428A

United States Patent [19]

Asano

[11] Patent Number: 5,704,428

[45] Date of Patent: Jan. 6, 1998

[54] DISASTER PREVENTIVE APPARATUS

[76] Inventor: Tokio Asano, 4215 W. 231st St., Torrance, Calif. 90505

[21] Appl. No.: 727,800

[22] Filed: Oct. 7, 1996

[51] Int. Cl.[6] ..... A62C 13/62

[52] U.S. Cl. ..... 169/74; 169/75; 169/89

[58] Field of Search ..... 169/71, 74, 75, 169/89

[56] References Cited

U.S. PATENT DOCUMENTS

| | | | |
|---|---|---|---|
| 4,006,780 | 2/1977 | Zehr | 169/74 |
| 4,620,598 | 11/1986 | Reeder | 169/74 |
| 5,615,743 | 4/1997 | Matsumoto et al. | 169/71 |

FOREIGN PATENT DOCUMENTS

| | | | |
|---|---|---|---|
| 640469 | 7/1928 | France | 169/89 |
| 2143035 | 3/1973 | Germany | 169/74 |
| 279031 | 10/1930 | Italy | 169/89 |
| 1147415 | 3/1985 | U.S.S.R. | 169/71 |

*Primary Examiner*—Gary C. Hoge

*Attorney, Agent, or Firm*—Frishauf, Holtz, Goodman, Langer & Chick

[57] ABSTRACT

A disaster preventive apparatus has a gas cylinder support to which the head of a gas cylinder filled with $CO_2$ gas is fixed, and the support is screwed in a top cover. When a bottom cover is turned by one hand while the top cover being held by the other hand after a lock pin, which locks the top cover and the gas cylinder support in a nonrotatable manner, is pulled out, the gas cylinder can be moved in the axial direction to the trigger side while being turned with a small force. Since the trigger is formed into a special shape such that the tip end face thereof and the outer peripheral surface of trigger tip end portion make an obtuse angle, a seal plate can be broken easily. Also, the broken portion of the seal plate is not separated from the seal plate and is bent inward in the gas cylinder, so that the ejection of $CO_2$ gas is not hindered by seal plate chips. There is less possibility of bending and breaking of the trigger.

10 Claims, 3 Drawing Sheets

DISASTER PREVENTIVE APPARATUS

BACKGROUND OF THE INVENTION

1. Field of the Invention

The present invention relates to a disaster preventive apparatus.

2. Prior Art

A disaster preventive apparatus is known, which, having a gas cylinder filled with $CO_2$ gas and a cylindrical cover screwed on the cylinder head, is used to perform work of fire extinguishing, cleaning, cooling, etc. by breaking a seal plate by means of a trigger provided on the cover to eject the $CO_2$ gas from the gas cylinder. The gas cylinder is held by a lock pin so as to be incapable of being turned with respect to the cover. When using the disaster preventive apparatus, the user pulls out the lock pin, and then, with the cover being grasped by one hand, turns the gas cylinder by the other hand to move the gas cylinder close to the trigger. When the seal plate of gas cylinder is broken by the trigger, the $CO_2$ gas in the gas cylinder is ejected to the outside of the disaster preventive apparatus through a gas passage including a gas ejection hole formed in the trigger. In fire-extinguishing work, the $CO_2$ gas is ejected to the origin of a fire. Also, the disaster preventive apparatus can be used to remove dust etc. sticking to electrical equipment installed in a computer room, power distribution room, etc. by ejecting $CO_2$ gas to the electrical equipment, or to cool a radiator and an engine by ejecting $CO_2$ gas to these elements after a hood is opened when overheat occurs on an automobile etc.

However, the disaster preventive apparatus of this type has a disadvantage of requiring a force for turning the gas cylinder to eject the gas. Also, the $CO_2$ gas ejecting from the gas cylinder sometimes leaks, though in a small amount, via a through hole from which the lock pin is pulled out. Sometimes, a seal plate chip separated from the seal plate when the seal plate is broken by the trigger closes the gas ejection hole to hinder the ejection of $CO_2$ gas. If a hanging device is installed on the disaster preventive apparatus to hang it on a hook on a wall surface, the disaster preventive apparatus becomes large in size, so that it cannot be stored in a desk drawer etc.

SUMMARY OF THE INVENTION

An object of the present invention is to provide a disaster preventive apparatus in which a gas cylinder can be turned with a small force when gas is ejected from the gas cylinder.

Another object of the present invention is to provide a disaster preventive apparatus which can supply all amounts of gas to the intended work by preventing the ejected gas from leaking through through holes after a lock pin, which makes the turning of the gas cylinder with respect to a cover impossible, is pulled out.

Still another object of the present invention is to provide a disaster preventive apparatus in which gas ejection is not hindered by seal plate chips by preventing the seal plate chips from being separated from the seal plate when the seal plate of gas cylinder is broken by a trigger.

A further object of the present invention is to provide a compact disaster preventive apparatus which can be stored in a desk drawer etc. or can be hung on a hook on a wall surface.

Another object of the present invention is to provide a disaster preventive apparatus with a long service life, in which breakage of trigger tip end portion can be prevented and the cover can be used repeatedly.

An additional object of the present invention is to provide a disaster preventive apparatus which has a simple construction and can be manufactured at a low cost.

Another object of the present invention is to provide a disaster preventive apparatus in which the user's hand holding the gas cylinder is not cooled.

The disaster preventive apparatus according to the present invention comprises: a gas cylinder filled with incombustible gas, the gas cylinder having a seal plate for sealing the head thereof; a trigger for breaking the seal plate of the gas cylinder, the trigger being formed with a first gas passage extending through the trigger; an annular gas cylinder support to which the head of the gas cylinder is fixed, the gas cylinder support defining a trigger containing space and being formed with a through hole extending in the radial direction at the end portion on the side opposite to the gas cylinder; a first cover screwed on the outer peripheral surface of the gas cylinder support, the first cover having a trigger mounting portion which is provided in the trigger containing space of the gas cylinder support and which is fixedly mounted with the trigger and having a peripheral wall which is formed with a through hole extending in the radial direction in alignment with the through hole of the gas cylinder support, the first cover being formed with a second gas passage whose one end communicates with the first gas passage in the trigger and the other end is open to the outside face of the first cover; and a lock pin inserted in the through holes in the gas cylinder support and the first cover, the lock pin positioning the first cover so that the trigger is separated from the seal plate.

Preferably, the disaster preventive apparatus further comprises a second cover fitted to the end portion of the gas cylinder on the side opposite to the head. More preferably, the second cover is made of a heat insulating material, and the outer peripheral surface of the gas cylinder is coated with a heat insulating material.

Preferably, the first cover has a first cover member and a second cover member. The first cover member has a peripheral wall defining a second cover member containing space and a top wall which is formed with a central hole. On the inner peripheral surface of the peripheral wall of the first cover member, threads engaging with threads on the outer peripheral surface of the gas cylinder support are formed and a step is formed at an axial position on the side opposite to the gas cylinder from the threads on the first cover member. The second cover member has a body, a first collar provided at the end of the body on the gas cylinder side and extending outward in the radial direction, and a second collar extending outward in the radial direction from an intermediate axial position of the body. The end of the body of the second cover member on the side opposite to the gas cylinder fits into the central hole in the top wall of the first cover member, and the outer peripheral edge of the second collar engages with the step on the inner peripheral surface of the peripheral wall of the first cover member. The first collar of the second cover member and the end portion of the body of the second cover member on the gas cylinder side are provided with the trigger mounting portion extending on the axes thereof. The body of the second cover member is formed with the second gas passage extending on the axis thereof.

Preferably, the lock pin is provided at the outer end thereof with a support pin, and a hanging device is supported rotatably around the support pin by the support pin.

Preferably, the tip end portion of the trigger is formed into a tapered shape, and the tip end face of the trigger extends at an angle with respect to a plane extending perpendicularly to the trigger axis. More preferably, the tip end face of the trigger and the outer peripheral surface of the tip end portion of the trigger make an angle of 90 degrees and over. More preferably, the outer peripheral surface of the tip end portion of the trigger extends at an angle of 10 degrees with respect to the trigger axis, and the tip end face of the trigger extends at an angle of 10 degrees with respect to a plane extending perpendicularly to the trigger axis.

Preferably, the axial position at which the second collar is provided is determined in such a manner that when the through hole Of the top cover and the through hole of the gas cylinder support are aligned with each other, the distance between the opposite faces of the second collar and the gas cylinder support is equal to or slightly larger than the distance between the opposite faces of the first collar and the seal plate of the gas cylinder. More preferably, a packing is mounted on the end face of the first collar on the gas cylinder side.

DETAILED DESCRIPTION OF THE PREFERRED EMBODIMENT

Figure 1:
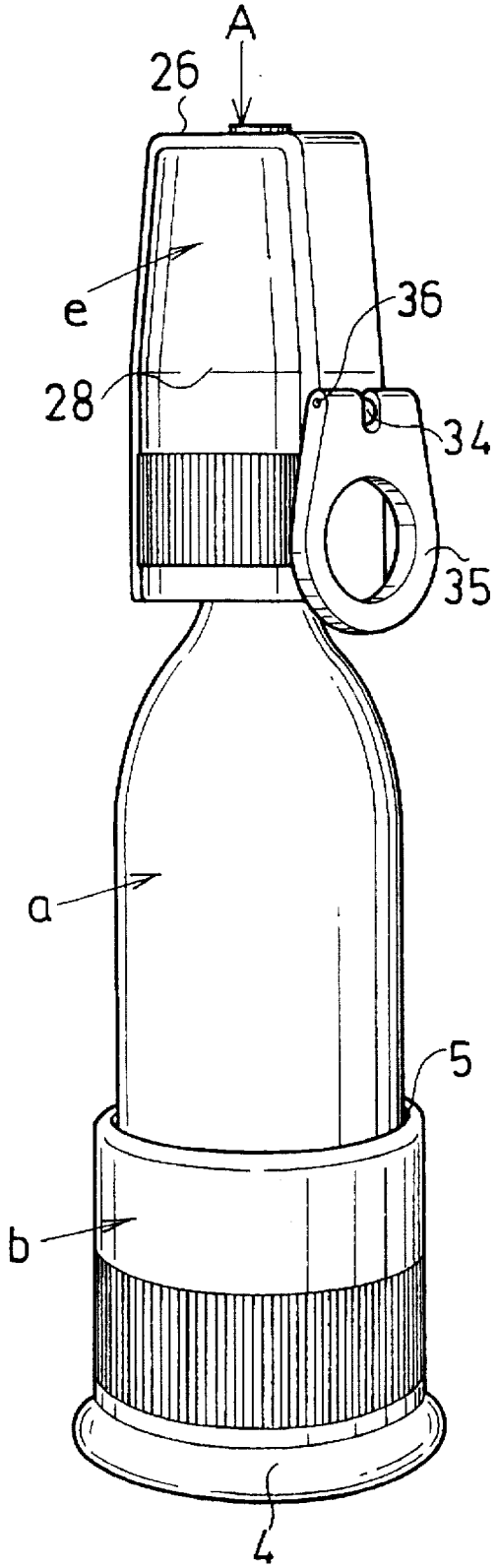
FIG. 1 is a perspective view of a disaster preventive apparatus according to one embodiment of the present invention.

A diaster preventive apparatus according to one embodiment of the present invention will be described with reference to FIGS. 1 to 4.

A disaster preventive apparatus A has a gas cylinder a filled with a incombustible gas such as $CO_2$ gas under a high pressure. The gas cylinder a, having a body and a head 1 with a diameter smaller than that of the body, is formed into a cylindrical shape as a whole and coated with a heat insulating material such as vinyl resin on the outer peripheral surface thereof. The gas cylinder head 1 is sealed by a seal plate 2, and external threads 3 are formed on the outer peripheral surface of the cylinder head 1. At an end portion opposite to the head of the gas cylinder a (hereinafter referred to as a lower end portion), a bottom cover (a second cover) b made of a heat insulating synthetic resin material etc. is fitted on the outside of the cylinder. The bottom cover b has a bottom wall 4 and a peripheral wall 5, and these walls 4 and 5 define a gas cylinder containing space 6 whose end on the gas cylinder side (an upper end) is open. The lower end portion of the gas cylinder a is fitted into this space 6 so that the gas cylinder does not separate easily from the bottom cover b.

Figure 3:
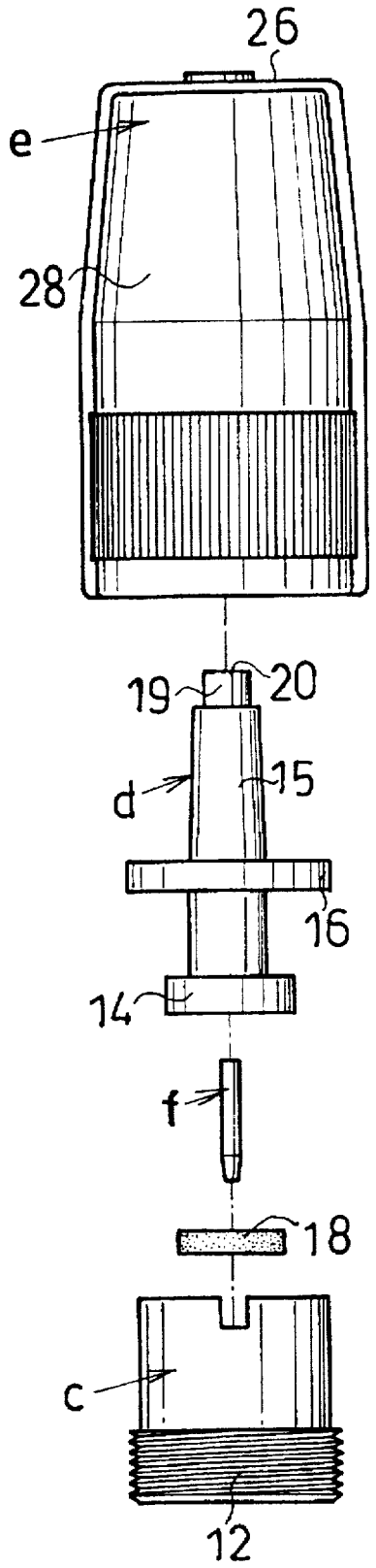
FIG. 3 is a front view showing a state in which vital components of the disaster preventive apparatus are disassembled.

The disaster preventive apparatus A has an annular gas cylinder support Q by which the head 1 of the gas cylinder a is fixed. This gas cylinder support c, which is made of a synthetic resin material etc., includes an upper annular member 7 defining a trigger containing space 8 whose upper end is open and a lower annular member 10 which is integral with the upper annular member 7. In order to reduce a force required for the turning of gas cylinder when the gas is ejected, the outside diameter of the lower annular member 10 is set at a value considerably larger than the outside diameter of the gas cylinder head 1. The outside diameter of the upper annular member 7 is set at a value slightly smaller than the outside diameter of the lower annular member 10. A small hole 13 extending in the radial direction is formed through the annular member 7 at the upper end portion of the upper annular member 7. Internal threads 11 are formed on the inner peripheral surface of the lower annular member 10 to engage with the external threads 3 on the outer peripheral surface of the cylinder head 1, and external threads 12 are formed on the outer peripheral surface of the lower annular member 10. As shown in FIG. 3, a notch into which a tool, not shown, can be fitted is provided at the upper end of the gas cylinder support c to provide convenience in screwing the gas cylinder support c onto the gas cylinder a.

The disaster preventive apparatus A has a cover assembly (a first cover) consisting of a trigger holder (a second cover member) d and a top cover (a first cover member) e. The trigger holder d and the top cover e are made of a synthetic resin material or the like.

The top cover e, including a top wall 26 through which a central hole 32 is formed and a peripheral wall 28 which is integral with the top wall 26, is formed into a cylindrical shape as a whole, and the lower end thereof is open as indicated by reference numeral 27. The peripheral wall 28 defines a trigger holder containing space. A step 29 engaging with the trigger holder d is formed on the inner peripheral surface of the peripheral wall 28 at an intermediate position in the axial direction of the peripheral wall 28. Also, on the inner peripheral surface of the peripheral wall 28 at the end portion on the lower side from the step 29, internal threads 30 engaging with the external threads 12 on the outer peripheral surface of the gas cylinder support c are formed. Further, a small hole 31 extending in the radial direction is formed through the peripheral wall 28 at a position in the axial direction between the step 29 and the internal threads 30. The peripheral wall 28 has an inside diameter slightly larger than the outside diameter of the upper annular member 7 of the gas cylinder support c.

The trigger holder d has a body 15 extending along the axis of the gas cylinder a in a trigger holder containing space 33 of the top cover e and the trigger containing space 8 of the gas cylinder support c. A small-diameter upper end portion 19 of the body 15 is fitted into the central hole 32 in the top wall 26 of the top cover e. The trigger holder d has a lower collar (a first collar) 14, which is provided at the lower end of the body 15 and extends outward in the radial direction, and an upper collar (a second collar) 16 extending outward in the radial direction from an intermediate portion in the axial direction of the body 15. The outer peripheral edge of the upper collar 16 engages with the step 29 on the inner peripheral surface of the top cover e. The first collar 14 has an outside diameter slightly smaller than the inside diameter of the upper annular member 7 of the gas cylinder support c, and the second collar 16 has an outside diameter approximately equal to the inside diameter of the peripheral wall 28 of the top cover e.

The axial position at which the upper collar 16 is provided is determined in such a manner that when the gas cylinder support c and the top cover e are fitted to each other so that the through holes 13 and 31 thereof are aligned with each other, the distance between the lower end surface of the upper collar 16 and the upper end face 7 of the gas cylinder support c is equal to or slightly larger than the distance between the lower end face of the lower collar 14 and the outside surface of the seal plate 2 of the gas cylinder a.

A trigger mounting hole is formed on the axis of the lower collar 14 and the lower end portion of the body 15. A recess 17 is provided on the lower end surface of the lower collar 14, and a packing 18, in which a trigger insertion hole is formed so as to align with the trigger mounting hole, is fitted in the recess 17. A trigger f for breaking the seal plate 2 of the gas cylinder a is inserted in the trigger mounting portion (trigger mounting hole and trigger insertion hole) in an undetachable manner. The trigger f is formed with a gas ejection hole (a first gas passage) 24 along the axis of the trigger f. Also, the body 15 is formed with a gas ejection hole (a second gas passage) 21 extending through the body 15 along the axis of the body 15. The lower end of the ejection hole 21 communicates with the ejection hole 24 of the trigger f, and the upper end of the hole 21 is open to an end face 20 of the upper end portion 19 of the body 15.

Figure 4:
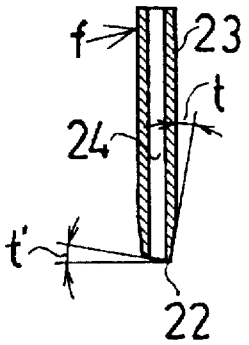
FIG. 4 is a longitudinal sectional view of a trigger for the disaster preventive apparatus.

As shown in FIGS. 3 and 4, the tip end portion of the trigger f is formed into a tapered shape, and the tip end face of the trigger extends at an angle with respect to a plane extending perpendicularly to the trigger axis. Preferably, the outer peripheral surface 23 of the tip end portion of the trigger f extends at an angle t of about 10 degrees with respect to the trigger axis, and the tip end face of the trigger f extends at an angle t' of about 10 degrees with respect to a plane extending perpendicularly to the trigger axis. That is to say, the tip end face of the trigger f and the outer peripheral surface of tip end portion of the trigger f make an angle of 90 degrees and over.

Figure 2:
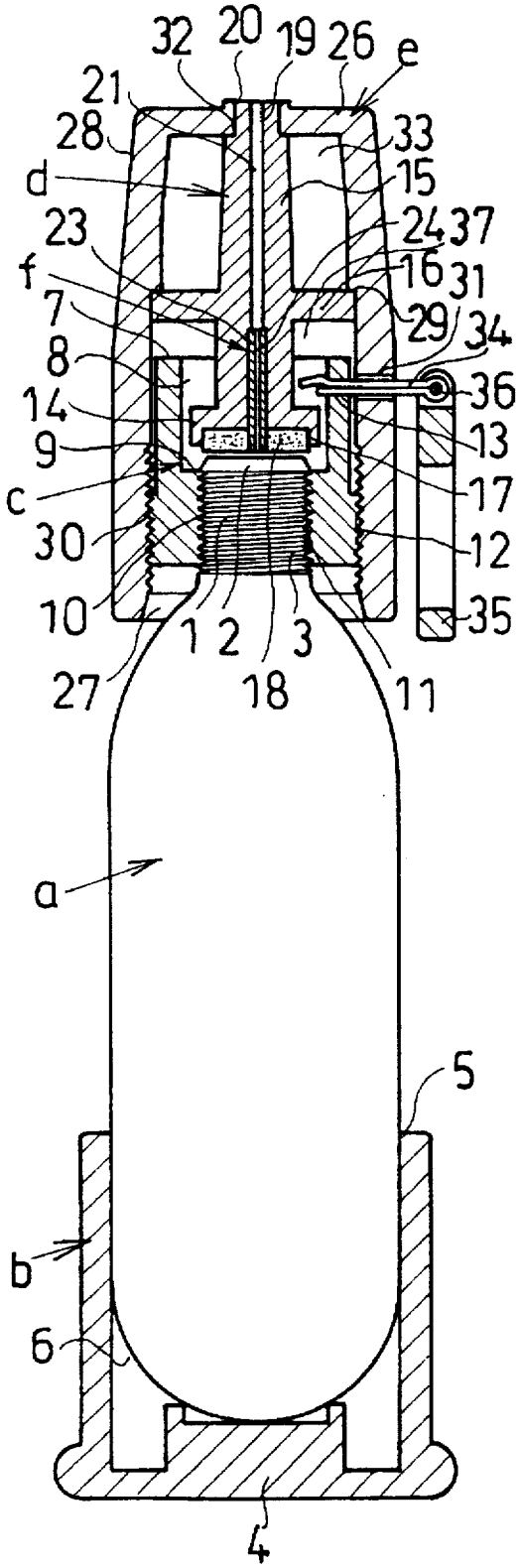
FIG. 2 is a longitudinal sectional view of the disaster preventive apparatus.

As shown in FIGS. 1 and 2, a hanging device 35 is supported by a support pin 36 inserted in the outer annular end of the lock pin 34 so as to be rotatable around the support pin 36.

The disaster preventive apparatus A of the above-described configuration is assembled by the following procedure.

First, the packing 18 is inserted in the lower end recess 17 of the body 15 of the trigger holder d. Next, the trigger f is inserted in the trigger insertion hole of the packing 18 and the trigger mounting hole of the body 15 of the trigger holder d. Further, the upper end 19 of the trigger holder d in which the trigger f is mounted is inserted in the central hole 32 of the top wall 26 of the top cover e, and the outer peripheral edge of the upper collar 16 of the trigger holder d is engaged with the inner peripheral surface step 29 of the peripheral wall 28 of the top cover e. Whereupon, the trigger holder d is installed to the top cover e so that it is not detached easily from the cover e to obtain the cover assembly d, e, f. On the other hand, the gas cylinder support c is screwed on the gas cylinder a in an undetachable manner to obtain a cylinder assembly a, c. Also, the hanging device 35 is mounted on the lock pin 34 via the support pin 36.

Next, the cylinder assembly a, c is threadedly attached to the cover assembly d, e, f by engaging the external threads 12 of the gas cylinder support c with the internal threads 30 of the top cover e. Then, the lock pin 34 to which the hanging device 35 is mounted is inserted in the small holes 31 and 13 with the small hole 31 of the top cover e and the small hole 13 of the gas cylinder support c being aligned with each other. Whereupon, the cylinder assembly a, c and the cover assembly d, e, f are coupled with each other in a nonrotatable manner. In this state, a gap 37 is formed between the lower collar 14 of the trigger holder d and the upper end face of the gas cylinder support c.

Finally, the bottom cover b is mounted at the lower end portion of the gas cylinder a in such a manner that the bottom cover b is not detached easily from the gas cylinder a, by which the assembly of the disaster preventive apparatus A is finished.

The following is a description of the operation of the above-described disaster preventive apparatus A.

In a fire-extinguishing, cleaning, or cooling operation, the user pulls out the lock pin 34 by his/her right hand, for example, while grasping the top holder e by his/her left hand to make the cylinder assembly a, b, c and the cover assembly d, e, f rotatable relatively to each other. Next, the user turns the bottom cover b while holding it by his/her right hand. When the bottom cover b is turned, the gas cylinder a and the gas cylinder support c are moved in the axial direction toward the trigger f in the top cover e while being turned.

Since the gas cylinder support c fixed to the gas cylinder a is screwed in the top cover e, a force required for the turning of the gas cylinder a can be saved as compared with the case where the gas cylinder a is directly screwed in the top cover e. This is because this configuration has the same effect as that of the configuration in which the diameter of the head 1 of the gas cylinder a is increased. Moreover, the diameter of the head 1 of the gas cylinder a and the area of the seal plate 2 can be the same as those of the prior art. Therefore, the gas sealing property of the gas cylinder a is not decreased by the increase in area of the seal plate 2. Also, the configuration of mounting the bottom cover b on the gas cylinder a contributes to a decrease in force required for the turning of the gas cylinder a.

As the cylinder assembly a, b, c advances in the axial direction, the small hole 31 of the top cover e is gradually covered by the upper annular member 7 of the gas cylinder support c. As the cylinder assembly a, b, c further advances in the axial direction, the seal plate 1 of the gas cylinder a abuts on the packing 18, and moves while compressing the packing 18. Then, a small central portion of the seal plate 2, which can be easily broken by the trigger f, surely strikes the tip end of the trigger f, and finally that portion of the seal plate 2 is broken by the trigger f.

When the seal plate 2 of the gas cylinder a is broken, the $CO_2$ gas put in the gas cylinder a under a high pressure is ejected to the ejection hole 21 in the trigger holder d through the through hole 24 in the trigger f, and then ejected to the outside of the disaster preventive apparatus A through the open end of the ejection hole 21. Thereupon, oxygen deficient fire-extinguishing and other operations are performed by ejecting the $CO_2$ gas to the things requiring fire-extinguishing, cleaning, or cooling operation.

The outer peripheral surface of the gas cylinder a is coated with a heat insulating material, and the bottom cover b is made of a heat insulating material. Therefore, the user's hand holding the bottom cover b is not cooled extremely by a low temperature generated by the ejection of the COgas.

Unlike the conventional trigger having a tip end of a sharp shape like a hypodermic needle, the trigger f of this embodiment is formed into a special shape shown in FIG. 4 such that the tip end face and the outer peripheral surface of the tip end portion of the trigger f make an angle of 90 degrees and over, that is, the tip end of the trigger f has an obtuse angle. Therefore, the portion of the seal plate 2 broken by the trigger f is not separated from the seal plate 2, and is bent inward in the gas cylinder a. For this reason, the broken portion of the seal plate 2 does not turn to chips which hinder the ejection of $CO_2$ gas.

Since the outer peripheral surface of tip end portion of the trigger f is formed into a tapered shape with an inclined angle of about 10 degrees, when breaking the seal plate 2, the tip end of the trigger f can smoothly break the seal plate 2 though the trigger f is subjected to a resistance. Therefore, the trigger f can be used many times because the tip end portion thereof is neither bent nor broken.

Before the seal plate 2 of the gas cylinder a is broken by the trigger f, the seal plate 2 abuts on the packing 18. Therefore, the packing 18 prevents the $CO_2$ gas ejected from the gas cylinder a from leaking through a gap between the opposite faces of the seal plate 2 and the lower collar 14 of the trigger holder d. Also, when the seal plate is broken, the upper end face of the lower annular member 10 of the gas cylinder support c comes in contact with or close to the lower end face of the lower collar 14 of the trigger holder d, and the upper end face of the upper annular member 7 of the gas cylinder support c comes in contact with or close to the lower end face of the upper collar 16 of the trigger holder d. The small hole 31 in the top cover e is covered by the upper annular member 7 of the gas cylinder support c. Therefore, even if the $CO_2$ gas leaks through a gap between the opposite faces of the seal plate 2 and the packing 18, the $CO_2$ gas is less prone to leak through the small hole 31 because the flow path resistance of the gas leaking path reaching the small hole 31 of the top cover e from this gap is high.

For the disaster preventive apparatus A, the gas cylinder a is replaceable. In order to replace the gas cylinder a, the gas cylinder a which has been used for fire-extinguishing and other operations is turned via the bottom cover b in the direction reverse to the turning direction for the ejection of $CO_2$ gas to remove the cylinder assembly a, b, c from the cover assembly d, e, f with the trigger. The removed cylinder assembly a, b, c is thrown away, but the cover assembly d, e, f with the trigger can be reused well. Accordingly, an unused cylinder assembly a, b, c is mounted to the reused cover assembly d, e, f, and then the lock pin 34 with the hanging device 35 is inserted in the small holes 31 and 13 of the top cover e and a new gas cylinder support c, respectively, to newly assemble the disaster preventive apparatus A. In such a manner, the cover assembly d, e, f can be reused many times.

In storing the disaster preventive apparatus A, the hanging device 35 of the disaster preventive apparatus A may be hung on a hook (not shown) provided on a wall surface, or the disaster preventive apparatus A may be stored in a drawer etc. by folding the hanging device 35 as shown in FIGS. 1 and 2.

What is claimed is:

1. A disaster preventive apparatus comprising:

a gas cylinder filled with incombustible gas, said gas cylinder having a seal plate for sealing a head thereof;

a trigger for breaking said seal plate of said gas cylinder, said trigger being formed with a first gas passage extending through said trigger;

an annular gas cylinder support to which said head of said gas cylinder is fixed, said gas cylinder support defining a trigger containing space and being formed at an end portion thereof on the side opposite to said gas cylinder with a through hole extending in a radial direction;

a first cover screwed on an outer peripheral surface of said gas cylinder support, said first cover having a trigger mounting portion which is provided in said trigger containing space of said gas cylinder support and which is fixedly mounted with said trigger and having a peripheral wall which is formed with a through hole extending in the radial direction in alignment with said through hole of said gas cylinder support, said first cover being formed with a second gas passage whose one end communicates with said first gas passage in said trigger and whose another end is open to an outside face of said first cover; and a lock pin inserted in said through holes in said gas cylinder support and said first cover, said lock pin positioning said first cover so that said trigger is separated from said seal plate.

2. A disaster preventive apparatus according to claim 1, further comprising:

a second cover fitted to an end portion of said gas cylinder on the side opposite to said head.

3. A disaster preventive apparatus according to claim 2, wherein said second cover is made of a heat insulating material, and an outer peripheral surface of said gas cylinder is coated with a heat insulating material.

4. A disaster preventive apparatus according to claim 1, wherein:

said first cover has a first cover member and a second cover member;

said first cover member has a peripheral wall defining a second cover member containing space and a top wall which is formed with a central hole, and on an inner peripheral surface of said peripheral wall of said first cover member, threads engaging with threads on the outer peripheral surface of said gas cylinder support are formed and a step is formed at an axial position on the side opposite to the gas cylinder from the threads on said first cover member;

said second cover member has a body, a first collar provided at an end of said body on the gas cylinder side and extending outward in the radial direction, and a second collar extending outward in the radial direction from an intermediate axial position of said body, said end of the body of said second cover member on the side opposite to the gas cylinder fits into said central hole in said top wall of said first cover member, and an outer peripheral edge of said second collar engages with said step on the inner peripheral surface of said peripheral wall of said first cover member; and said first collar of said second cover member and the end portion of said body of said second cover member on the gas cylinder side are provided with said trigger mounting portion extending on the axes thereof, and said body of said second cover member is formed with said second gas passage extending on the axis thereof.

5. A disaster preventive apparatus according to claim 1, wherein said lock pin is provided at an outer end thereof with a support pin, and a hanging device is supported rotatably around said support pin by said support pin.

6. A disaster preventive apparatus according to claim 1, wherein a tip end portion of said trigger is formed into a tapered shape, and a tip end face of said trigger extends at an angle with respect to a plane extending perpendicularly to an axis of said trigger.

7. A disaster preventive apparatus according to claim 6, wherein said tip end face of said trigger and an outer peripheral surface of said tip end portion of said trigger make an angle of 90 degrees and over.

8. A disaster preventive apparatus according to claim 7, wherein said outer peripheral surface of said tip end portion of said trigger extends at an angle of 10 degrees with respect to the axis of said trigger, and said tip end face of said trigger extends at an angle of 10 degrees with respect to a plane perpendicular to the axis of said trigger.

9. A disaster preventive apparatus according to claim 4, wherein an axial position at which said second collar is provided is determined in such a manner that when said through hole of said top cover and said through hole of said gas cylinder support are aligned with each other, a distance between opposite faces of said second collar and said gas cylinder support is equal to or slightly larger than a distance between opposite faces of said first collar and said seal plate of said gas cylinder.

10. A disaster preventive apparatus according to claim 4, wherein a packing is mounted on an end face of said first collar on the gas cylinder side.

* * * * *